United States Patent [19]

Blaha

[11] Patent Number: 4,824,395

[45] Date of Patent: Apr. 25, 1989

[54] PUSH-IN WIRE CONNECTOR

[75] Inventor: William E. Blaha, St. Charles, Ill.

[73] Assignee: Ideal Industries, Inc., Sycamore, Ill.

[21] Appl. No.: 153,052

[22] Filed: Feb. 8, 1988

[51] Int. Cl.[4] ..... H01R 4/24

[52] U.S. Cl. ..... 439/438

[58] Field of Search ..... 439/161, 436–441

[56] References Cited

U.S. PATENT DOCUMENTS 4,397,514 8/1983 Durand et al. ..... 439/436

FOREIGN PATENT DOCUMENTS 2553558 6/1977 Fed. Rep. of Germany ..... 439/438
2700793 7/1978 Fed. Rep. of Germany ..... 439/437
391034 8/1965 Switzerland ..... 439/436

*Primary Examiner*—Joseph H. McGlynn
*Attorney, Agent, or Firm*—Kinzer, Plyer, Dorn, McEachran & Jambor

[57] ABSTRACT

A push-in wire connector for providing electrical connection between two or more conductors includes a housing defining an enclosure with a one-piece, conductive clip disposed in the housing. There are apertures in the housing to permit entry of the wires which are to be connected. The clip has first and second portions. The first portion is held fixed in the housing and the second portion is folded back on the first to define a cantilever spring. The spring is normally disposed opposite the apertures. When conductors are inserted into the housing they deflect the spring. The spring is then engaged with the wires to impart a clamping force which retains the wires in the housing. The clip is made of a bimetallic strip of material which, when heated by electrical current, expands in such a manner that the clamping force on the wires is increased. The exterior of the housing has a dovetail pin and socket arrangement which permits stacking of multiple, like connectors.

11 Claims, 2 Drawing Sheets

Fig. 1.
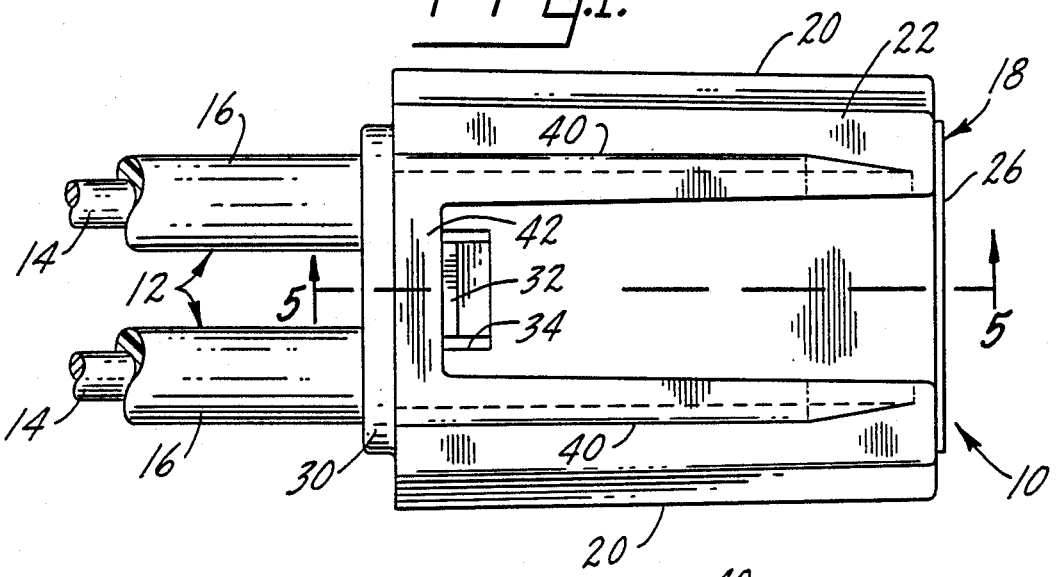
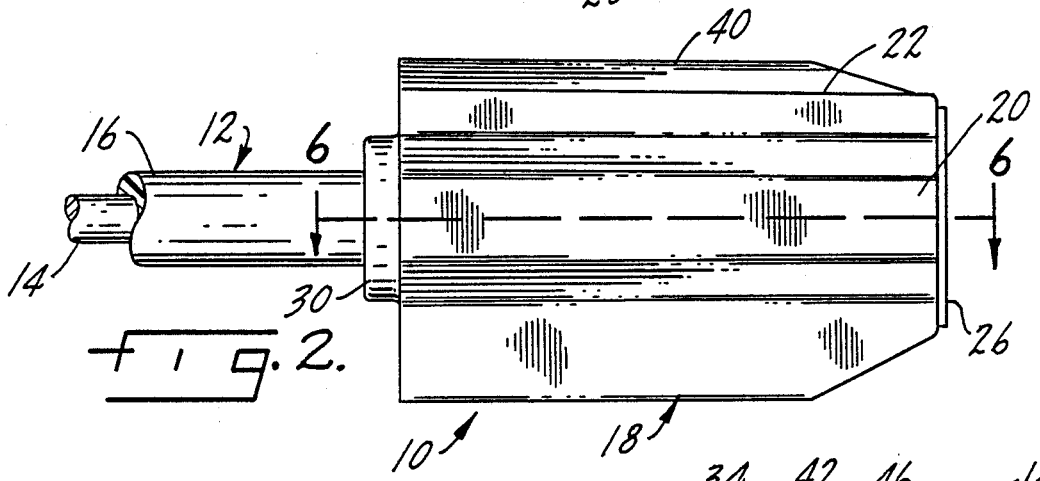
Fig. 2.
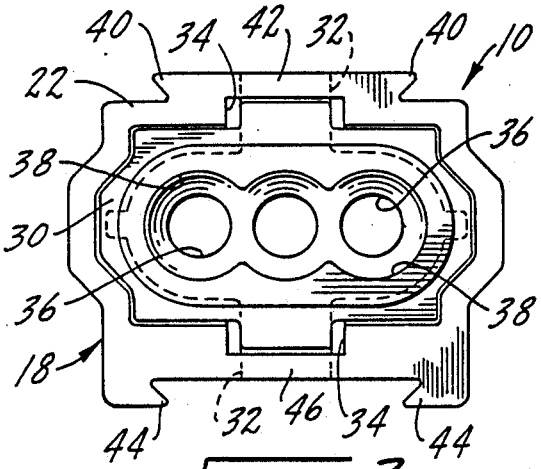
Fig. 3.
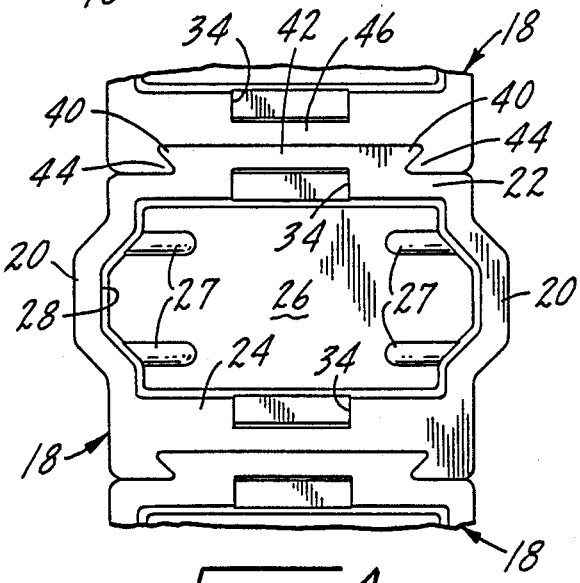
Fig. 4.

PUSH-IN WIRE CONNECTOR

SUMMARY OF THE INVENTION

This invention relates to push-in electrical connectors of the type wherein the stripped ends of electrical wires are pushed into the connector for the purpose of making electrical and mechanical connection between the wires.

A primary object of the invention is an electrical connector having a conductive clip of relatively simple design which is convenient to fabricate.

A further object of the invention is an electrical connector having a pin and socket arrangement on its exterior surface allowing stacking of multiple, like connectors.

Yet another object of the invention is an electrical connector of the type described having a conductive clip made of a bimetallic strip which is configured so as to increase the clamping force on connected wires when the clip is heated by electric current.

Another object of the invention is an electrical connector which is as small as possible for a three-piece structure.

Another object of the invention is an electrical connector with which connections can be rapidly and easily made.

Another object of the invention is a wire connector which can accommodate different size wires in one unit.

Another object of the invention is an electrical connector having a conductive clip with individual fingers which can operate independently to engage the conductors of the wires inserted into the connector. The fingers may have V-shaped notches formed on the ends of the fingers to grip the conductors inserted into the connector.

A further object of the invention is an electrical conductor having a conductive clip comprising first and second portions. The first portion is a flat plate. The second portion is a U-shaped piece cantilevered from the end of the base and extending toward the plate. The U-shaped piece is located adjacent the openings for the wires. There are holes in the U-shaped piece permitting entrance of the wire conductors.

These and other objects will appear from time to time in the following specification, drawings and claims.

BRIEF DESCRIPTION OF THE DRAWINGS

FIG. 1 is a top plan view of the connector of the present invention.

FIG. 2 is a side elevation view of the connector.

FIG. 3 is an end elevation view of the connector.

FIG. 4 is an end elevation view of the housing body, with the insert removed to show the interior of the body, and illustrating the stacking arrangement for multiple, like connectors.

DETAILED DESCRIPTION OF THE INVENTION

Figure 5:
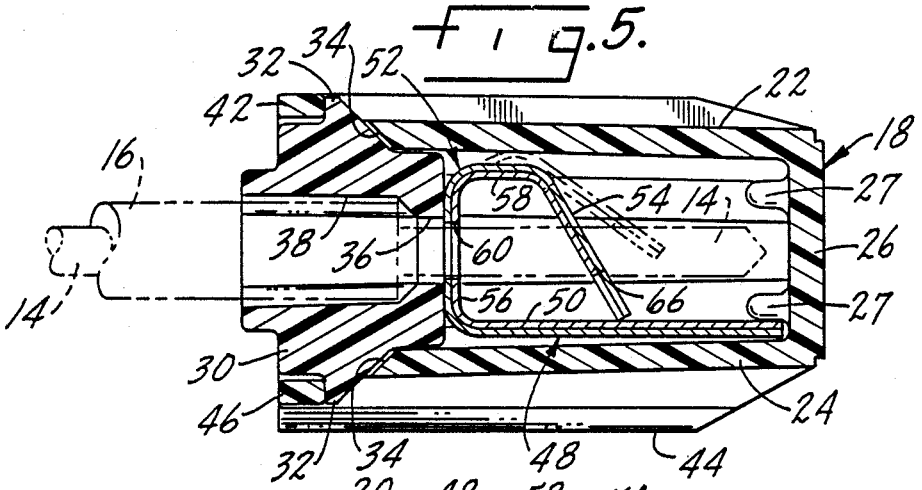
FIG. 5 is a section taken along line 5—5 of FIG. 1.

FIGS. 1–4 illustrate the exterior portion of the electrical connector 10 of the present invention. The connector is used to make electrical connection between two or more wires 12. The wires are of the type having a conductor 14 surrounded by insulation 16.

The connector 10 comprises a housing, shown generally at 18. The housing has a body member formed by side walls 20, a top wall 22, a bottom wall 24 and one end wall 26. Four lugs 27 are formed on the interior surface of end wall 26. The walls define a five-sided, hollow enclosure having an open side indicated at 28. The housing can by made of nylon, polypropylene or any suitable thermoplastic material.

Figure 6:
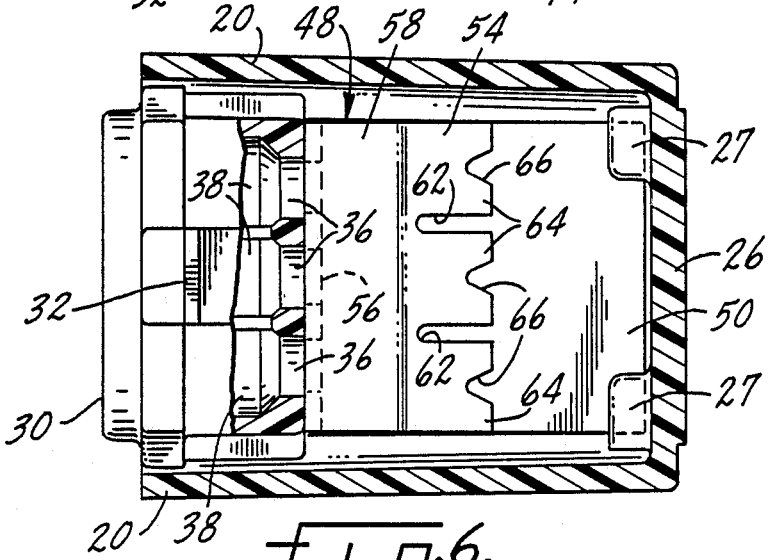
FIG. 6 is a section taken along line 6—6 of FIG. 2.

The open side 28 of the body member is substantially filled by an insert 30, as best seen in FIGS. 3, 5 and 6. The insert has tabs 32 on its upper and lower surfaces. The tabs extend into openings 34 in the top and bottom walls of the body member to retain the insert in the enclosure of the body member as described below. The insert has a plurality of apertures 36 extending therethrough. Coaxial counterbores 38 communicate with the apertures 36. The counterbores 38 accommodate the insulation 16 of wires inserted into the connectors. Similarly, the apertures 36 allow entry of the stripped ends of conductors 14 into the enclosure. The apertures are sized according to the gauge of wire to be connected. The apertures may all be of the same size or there could be different sized apertures in the same connector for connecting wires of different gauges. The insert guides the wires into the clip, as will be described below. Also, the insert provides insulation which prevents shorting or arcing.

The housing further includes attachment means which allows stacking or interconnecting of multiple, like connectors. In the illustrated embodiment the attachment means comprises a pair of cooperating, elongated male pins 40 located on the top wall 22 of the housing. The pins are connected at the open side of the body member by a web 42. The web overlies the opening 34 in the top wall and engages the tab 32 of the insert to retain the insert in place. On the bottom wall 24 there are a pair of cooperating female pins 44, which together define a socket into which the pins 40 of a second, like connector fit. As best seen in FIGS. 3 and 4 the net effect of the pins 40 and 44 is that of a dovetail arrangement. A web 46, similar to the web 42, spans the lower opening 34 to retain the lower tab 32.

Figure 7:
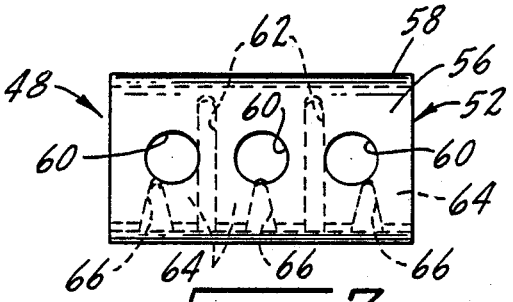
FIG. 7 is an end elevation view of the conductive clip.

Turning now to FIGS. 5–7, a one-piece conductive clip, shown generally at 48, is disposed inside the enclosure formed by the housing 18. The clip has first and second portions 50 and 52, respectively. The first portion is a flat plate having its free end trapped between two of the lugs 27 and the bottom wall 24. It will be noted that an extra set of lugs is provided so that the clip may be inserted with the first portion adjacent either the top or bottom wall.

The second portion 52 of the clip is a generally U-shaped piece having legs 54 and 56 separated by a bight 58. Leg 56 is connected to the first portion 50 of the clip. It extends upwardly adjacent the apertures 36 in the insert 30. Holes 60 in the leg 56 permit passage of conductors 14 into the housing enclosure. The bight 58 and leg 54 are cantilevered from the upper end of leg 56. The leg 54 defines a spring which is normally located opposite the apertures 36 and holes 60. This is the position shown in solid lines in FIG. 5. When conductors are inserted into the housing they will necessarily impinge on the spring defined by leg 54. Further insertion of the conductors will cause the spring to deflect to the position shown in dotted lines in FIG. 5. This flexing of the spring is possible because the first portion 50 of the clip is held fixed by the lugs 27. Thus, the conductors 14 separate the first and second portions of the clip from their normal, relaxed positions. This generates a clamping force, imparted by the spring to the conductors. The clamping force retains the conductors in the housing.

The leg 54 has a pair of longitudinal slits 62 which define individual fingers 64 on the free end of the leg. The fingers have V-shaped notches 66 which assist in gripping the conductor inserted underneath a finger. Further enhancement of the clamping force is provided by the construction of the clip. The clip may be a bimetallic part which when heated by electrical current expands in a manner which increases the clamping force. That is, the leg 54 tends to expand toward the first portion 50. This raises the clamping force on the conductors. The clip may be formed from a strip made of about one half steel and one half copper alloy, with the copper on the inside and the steel on the outside, as shown in FIG. 5.

Alternatively, the clip may be made of a copper alloy instead of the bimetal. A suitable copper alloy has been found to be: Nickel 3.0%; Silicon 0.65%; Magnesium 0.15%; and Copper remainder. Another possible alloy is: Nickel 12%; Aluminum 2%; Manganese 0.35%; Magnesium 0.2%; and Copper remainder. Additional possible materials for the clip are #510 phosphor bronze and two types of spring temper brass.

The use of the connector is as follows. The stripped ends of wires ar inserted into the counterbores 38 of the insert 30. The wires are pushed in until either the conductor 14 bottoms on end wall 26 or the insulation 16 bottoms in a counterbore. As the conductor moves into the enclosure, it contacts one of the fingers 64, moving it counterclockwise, as seen in FIG. 5. As additional conductors are inserted they similarly engage a finger of the leg 54. Since the clip 48 is a single part, the conductors are shorted and electrical connection is established. The notches 66 grip the conductor 14 to retain it in the housing.

Whereas a preferred form of the invention has been shown and described, it will be realized that alterations may be made thereto without departing from the scope of the following claims. For example, the number of apertures 36 and corresponding holes 60 in the clip 48 could be greater to accommodate an increase in the number of wires insertable into a single connector.

I claim:

1. A connector for connecting electrical conductors, comprising:

a housing defining an enclosure and at least one opening providing access to the enclosure;

at least one lug formed on the housing and extending into the enclosure; and a one-piece, conductive clip disposed in the housing, having a first, flat portion and a second, curved portion, the first portion engaging the lug to retain the first portion in a fixed position in the housing and the second portion having a hole aligned with the housing opening to permit electrical conductors to be inserted into the housing, between the first and second portions of the conductive clip, the second portion being folded back on the first portion to define a cantilevered spring normally located opposite the opening in the housing such that the spring is deflected away from the first portion of the clip by electrical conductors inserted into the housing, the deflected spring being engageable with the conductors to impart a clamping force on them to retain them in the housing and provide electrical connection between said conductors.

2. The connector of claim 1 wherein the housing comprises:

a body member having a plurality of walls defining said enclosure and having at least one open side defining said opening; and an insert engageable with the body member and sized to substantially close the open side of the body member and retain the clip within the enclosure, the insert having apertures therein for permitting entry of conductors into the housing.

3. The connector of claim 2 wherein the insert apertures have counterbores for accepting insulation on the conductors.

4. The connector of claim 1 wherein the first portion of the clip is a flat plate and the second portion of the clip is generally U-shaped, having two legs and a bight, one leg being connected at one end to the first portion of the clip with the bight extending from the other end of said on leg.

5. A connector for connecting electrical conductors, comprising:

a housing defining an enclosure and at least one opening providing access to the enclosure; and a one-piece, conductive clip disposed in the housing, having first and second portions, the first portion being fixedly attached to the housing and the second portion being folded back on the first portion to define a cantilevered spring normally located opposite the opening in the housing such that the spring is deflected by electrical conductors inserted into the housing, the deflected spring being engageable with the conductors to impart a clamping force on them to retain them in the housing and provide electrical connection between said conductors;

the first portion of the clip being a flat plate and the second portion of the clip being generally U-shaped, having two legs and a bight, one leg being connected at one end to the first portion of the clip with the bight extending from the other end of said one leg, and wherein said one leg is located adjacent the opening in the housing and has a plurality of holes permitting passage of conductors inserted into the connector.

6. The connector of claim 1 wherein the spring portion of the clip has at least one longitudinal slit therein defining individual fingers on the end of the spring portion.

7. The connector of claim 6 wherein the fingers have V-shaped notches formed in the ends thereof to grip conductors inserted into the housing.

8. The connector of claim 1 wherein the housing includes attachment means for mounting the connector.

9. The connector of claim 8 wherein the attachment means comprises at least one pin on one side of the housing and at least one socket on the other side of the housing sized to receive a pin of a cooperating, like connector.

10. A connector for connecting electrical conductors, comprising:

a housing defining an enclosure and at least one opening providing access to the enclosure; and a one-piece, conductive clip disposed in the housing, having first and second portions, the first portion being fixedly attached to the housing and the second portion being folded back on the first portion to define a cantilevered spring normally located opposite the opening in the housing such that the spring is deflected by electrical conductors inserted into the housing, the deflected spring being engageable with the conductors to impart a clamping force on them to retain them in the housing and provide electrical connection between said conductors, and wherein the clip is made of a bimetal such than when the clip is heated by the flow of electricity the clip expands in a manner which urges the spring to its normal position, thereby increasing the clamping force of the spring on the conductors.

11. A connector for connecting electrical conductors, comprising:

a housing defining an enclosure and at least one opening providing access to the enclosure;

at least one pin on one side of the housing and at least one socket on the other side of the housing sized to receive a pin of a cooperating, like connector, the pin and socket each having a dovetail shape such that they are engageable only by a relative sliding motion of cooperating connectors; and a conductive clip disposed in the housing, having first and second portions, the second portion being folded back on the first portion to define a cantilevered spring normally located opposite the opening in the housing such that the spring is deflected by electrical conductors inserted into the housing, the deflected spring being engageable with the conductors to impart a clamping force on them to retain them in the housing and provide electrical connection between said conductors.

* * * * *